US006945796B2

(12) United States Patent
Bassler et al.

(10) Patent No.: US 6,945,796 B2
(45) **Date of Patent: *Sep. 20, 2005**

(54) IMPEDANCE-TUNED CONNECTOR

(75) Inventors: Maxwill P. Bassler, Hampshire, IL (US); David L. Brunker, Naperville, IL (US); Daniel L. Dawiedczyk, Lisle, IL (US); John E. Lopata, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 32 days.

This patent is subject to a terminal disclaimer.

(21) Appl. No.: 10/246,829

(22) Filed: Sep. 19, 2002

(65) Prior Publication Data

US 2003/0032316 A1 Feb. 13, 2003

Related U.S. Application Data

(63) Continuation of application No. 09/607,234, filed on Jun. 30, 2000, now Pat. No. 6,457,983, which is a continuation-in-part of application No. 09/356,205, filed on Jul. 16, 1999, now Pat. No. 6,280,209.

(51) Int. Cl.[7] ..... H01R 13/658

(52) U.S. Cl. ..... 439/101; 439/108; 439/660; 439/502

(58) Field of Search ..... 439/101, 108, 439/685, 660, 610, 502

(56) References Cited

U.S. PATENT DOCUMENTS

| | | | | |
|---|---|---|---|---|
| 4,337,989 A | | 7/1982 | Asick et al. | |
| 4,628,410 A | | 12/1986 | Goodman et al. | |
| 4,678,121 A | | 7/1987 | Douty et al. | |
| 4,717,354 A | * | 1/1988 | McCleerey | 439/444 |
| 4,790,765 A | | 12/1988 | Ehrenfels et al. | |
| 4,824,383 A | | 4/1989 | Lemke | |
| 4,981,447 A | * | 1/1991 | Ichitsubo | 439/607 |
| 5,046,960 A | * | 9/1991 | Fedder | 439/608 |
| 5,256,085 A | | 10/1993 | Tan et al. | |
| 5,281,169 A | * | 1/1994 | Kiat et al. | 439/607 |
| 5,490,786 A | | 2/1996 | Mosquera et al. | |
| 5,525,067 A | | 6/1996 | Gatti | |
| 5,725,400 A | * | 3/1998 | Morikawa et al. | 439/874 |
| 5,876,248 A | * | 3/1999 | Brunker et al. | 439/108 |
| 5,895,276 A | * | 4/1999 | Rothenberger | 439/108 |
| 5,954,541 A | | 9/1999 | Ozai et al. | |
| 6,007,352 A | | 12/1999 | Azuma et al. | |
| 6,116,926 A | * | 9/2000 | Ortega et al. | 439/108 |
| 6,139,371 A | | 10/2000 | Troutman et al. | |
| 6,142,804 A | | 11/2000 | Peloza et al. | |
| 6,164,995 A | | 12/2000 | Peloza | |

FOREIGN PATENT DOCUMENTS

| | | |
|---|---|---|
| EP | 0 486 298 A1 | 5/1992 |
| EP | 0 529 350 | 3/1993 |
| EP | 0 793 297 | 9/1997 |
| EP | 0 836 247 | 4/1998 |
| JP | 09-221691 | 9/1999 |
| WO | WO 89/11169 | 11/1989 |
| WO | 00/10228 | 2/2000 |

OTHER PUBLICATIONS

Meeting Minutes from VESA Flat Panel Display Interface Committee, Jun. 13, 1996, VESA Doc #FPD 96/43.

Presentation by Don Chambers of JAE Electronics, Inc. Considerations for Connectors for the Vesa Flat Panel Display Interface–2, VESA Doc FPDI 96/39, Date perhaps Jun. 13, 1996.

Presentation by JAE Electronics, Inc. I/O Connector for LCD Display FI Series (for Vesa FPDI–2), VESA Doc #FPDI 91/22, date believed to be Feb. 13, 1997.

* cited by examiner

*Primary Examiner*—Briggitte L. Hammond
(74) *Attorney, Agent, or Firm*—Thomas D. Paulius

(57) ABSTRACT

A termination structure for mating a cable connector to a circuit board has a ground terminal and two signal terminals arranged in triangular pattern through the connector in order to reduce the impedance through the connector. The width of the ground terminal increases along its extent with respect to the signal terminals. This increase occurs along either a transition or contact portion of the ground terminal.

24 Claims, 9 Drawing Sheets

IMPEDANCE-TUNED CONNECTOR

REFERENCE TO RELATED APPLICATIONS

This application is a continuation application of prior application Ser. No. 09/607,234, filed Jun. 30, 2000, issued as U.S. Pat. No. 6,457,983 on Oct. 1, 2002, which is a continuation-in-part of prior application Ser. No. 09/356,205, filed Jul. 16, 1999, now U.S. Pat. No. 6,280,209.

BACKGROUND OF THE INVENTION

The present invention relates generally to terminations for connectors and more particularly to connectors used in connections with signal cables, especially high-speed signal cables, and printed circuit boards.

Many electronic devices rely upon transmission lines to transmit signals between related devices or between peripheral devices and circuit boards of a computer. These transmission lines incorporate signal cables that are capable of high-speed data transmissions.

These signal cables may use what are known as one or more twisted pairs of wires that are twisted together along the length of the cable, with each such twisted pair being encircled by an associated grounding shield. These twisted pairs typically receive complimentary signal voltages, i.e., one wire of the pair may see a +1.0 volt signal, while the other wire of the pair may see a −1.0 volt signal. Thus, these wires may be called "differential" pairs, a term that refers to the different signals they carry. As signal cables are routed on a path to an electronic device, they may pass by or near other electronic devices that emit their own electric field. These devices have the potential to create electromagnetic interference to transmission lines such as the aforementioned signal cables. However, this twisted pair construction minimizes or diminishes any induced electrical fields and thereby eliminates electromagnetic interference.

In order to maintain electrical performance integrity from such a transmission line, or cable, to the circuitry of an associated electronic device, it is desirable to obtain a substantially constant impedance throughout the transmission line, from circuit to circuit or to avoid large discontinuities in the impedance of the transmission line. The difficulty of controlling the impedance of a connector at a connector mating face is well known because the impedance of a conventional connector typically changes through the connector and across the interface of the two mating connector components. Although it is relatively easy to maintain a desired impedance through an electrical transmission line, such as a cable, by maintaining a specific geometry or physical arrangement of the signal conductors and the grounding shield, an impedance change is usually encountered in the area where a cable is mated to a connector. It is therefore desirable to maintain a desired impedance throughout the connector and its connection to the cable.

The present invention is therefore directed to a termination structure for providing improved connections between cables and connectors that provides a high level of performance and which maintains the electrical characteristics of the cable in the termination area.

SUMMARY OF THE INVENTION

Accordingly, it is a general object of the present invention to provide an improved connector for high-speed data transmission connections in which the impedance discontinuity through the connector is minimized so as to better attempt to match the impedance of the transmission line.

Another object of the present invention is to provide an improved connector for effecting a high-performance connection between a circuit board and an opposing connector terminated to a transmission line, wherein the transmission line includes at least one pair of differential signal wires and an associated ground and the opposing connector includes at least two signal and one ground terminal, the connector having a pair of signal terminals disposed therein and a ground terminal associated therewith, the signal and ground terminals of the connector being arranged in a manner so as to reduce impedance discontinuities from occurring when the connector is mated to the opposing connector.

It is a further object of the present invention to provide such a connector wherein, by varying the size of the ground terminal and its location relative to its two associated signal wires, the impedance of the connector may be "tuned" to obtain a preselected impedance through the connector.

Yet another object of the present invention is to provide a connector for connecting cables, such as those of the IEEE 1394 type, to a circuit board of an electronic device, wherein the connector has a number of discrete, differential signal wires and associated grounds equal in number to those contained in the cables, the ground terminals of the connector being configured in size and location with respect to the signal terminals of the connector in order to minimize the drop in impedance through the connector.

It is yet a further object of the present invention to provide a connector for providing a connection between a circuit board and a connector associated with a signal cable, wherein the connector includes a pair of differential signal terminals and a ground terminal associated with the pair of signal terminals, the ground terminal being sized to control the impedance through the connector, the ground terminal of the connector being spaced apart from the pair of signal terminals in a contact area to establish a desired electrical relationship among the three terminals.

A still other object of the present invention is to provide a board connector for mating to a cable connector, the board connector having a housing, a ground terminal positioned within the connector housing and spaced apart from two associated signal terminals, the ground terminal having a body portion that is larger than corresponding body portions of the two signal terminal.

A yet further object of the present invention is to provide a board connector for use in connections with cables, the connector having a ground terminal and two signal terminals that are arranged in a triangular orientation within a mating contact portion of the board connector.

In order to obtain the aforementioned objects, one principal aspect of the invention that is exemplified by one embodiment thereof includes a first connector for a circuit board which has a housing that supports, for each twisted pair of wires in the mating signal cable, three conductive terminals in a unique pattern of a triplet, with two of the terminals carrying differential signals, and the remaining terminal being a ground terminal that serves as a ground plane or ground return to the differential pair of signal wires. A second connector for a cable is provided that mates with the first connector and this second connector also has a triplet pattern of conductive terminals that are terminated to signal and ground wires of the cable.

The arrangement of these three terminals within the first connector permits the impedance to be more effectively controlled throughout the first connector, from the points of engagement with the cable connector terminals to be points of attachment to the circuit board. In this manner, each such triplet includes a pair of signal terminals having contact portions that are aligned together in side-by-side order, and which are also spaced apart a predetermined distance from each other.

The ground terminal is spaced apart from the two signal terminals so that two rows of terminals are presented in the connector. The ground terminal has a contact portion that is spaced apart from like contact portions of the signal terminals, while the remainder of the ground terminal may extend between the signal terminals. In this extent, the ground terminal may extend in a common plane as the two signal terminals.

The width of the ground terminal and its spacing from the signal terminals may be chosen so that the three terminals may have desired electrical characteristics such as capacitance and the like, which affect the impedance of the connector. The width of the ground terminal will usually be increased in the mating area along the contact portions of the terminals, but it may also be increased in the transition area that occurs between the contact and termination areas of the terminals.

By this impedance regulating ground structure, a greater opportunity is provided to reduce the impedance discontinuity which occurs in a connector without altering the mating positions or the pitch of the differential signal terminals. Hence, this aspect of the present invention may be aptly characterized as providing a "tunable" terminal arrangement for each differential signal wire pair and associated ground wire arrangement found either in a cable or in other circuits.

In another principal aspect of the present invention, two or more such tunable triplets may be provided within the connector housing, but separated by an extent of dielectric material, such as the connector housing, an air gap, or both. In order to maximize the high speed performance of such a connector, the signal and ground terminals preferably all have similar, flat contacts that are cantilevered from their associated body portions so that the ground terminal contact portions may be selectively sized with respect to their associated signal terminals to facilitate the tuning of the terminals to obtain the optimum desired impedance in the connector system. When two such triple terminal sets are utilized in the connectors of the present invention, power terminals of the connector may be situated between the two triple terminal sets at a level equal to that of the ground terminals so as not to interfere with the signal terminals.

In still another principal aspect of the present invention, the connector has its ground and signal terminals arranged in a triangular orientation to maintain the predetermined spatial relationships that occur among these three terminals in the mating area of the board connector.

BRIEF DESCRIPTION OF THE DRAWINGS

In the course of the following detailed description, reference will be made to the accompanying drawings wherein like reference numerals identify like parts and in which.

DETAILED DESCRIPTION OF THE PREFERRED EMBODIMENTS

The present invention is directed to an improved connector particularly useful in enhancing the performance of high-speed cables, particularly in input-output ("I/O") applications as well as other type of applications. More specifically, the present invention attempts to impose a measure of mechanical and electrical uniformity on the termination area of the connector to facilitate its performance, both alone and when combined with an opposing connector.

Many peripheral devices associated with an electronic device, such as a video camera or camcorder, transmit digital signals at various frequencies. Other devices associated with a computer, such as the CPU portion thereof, operate at high speeds for data transmission. High speed cables are used to connect these devices to the CPU and may also be used in some applications to connect two or more CPUs together. A particular cable may be sufficiently constructed to convey high speed signals and may include differential pairs of signal wires, either as twisted pairs or individual pairs of wires.

One consideration in high speed data transmissions is signal degradation. This involves crosstalk and signal reflection which is affected by the impedance of the cable and connector. Crosstalk and signal reflection in a cable may be easily controlled easy enough in a cable by shielding and the use of differential pairs of signal wires, but these aspects are harder to control in a connector by virtue of the various and diverse materials used in the connector, among other considerations. The physical size of the connector in high speed applications limits the extent to which the connector and terminal structure may be modified to obtain a particular electrical performance.

Impedance mismatches in a transmission path can cause signal reflection, which often leads to signal losses, cancellation, etc. Accordingly, it is desirable to keep the impedance consistent over the signal path in order to maintain the integrity of the transmitted signals. The connector to which the cable is terminated and which supplies a means of conveying the transmitted signals to circuitry on the printed circuit board of the device is usually not very well controlled insofar as impedance is concerned and it may vary greatly from that of the cable. A mismatch in impedances between these two elements may result in transmission errors, limited bandwidth and the like.

Figure 11:
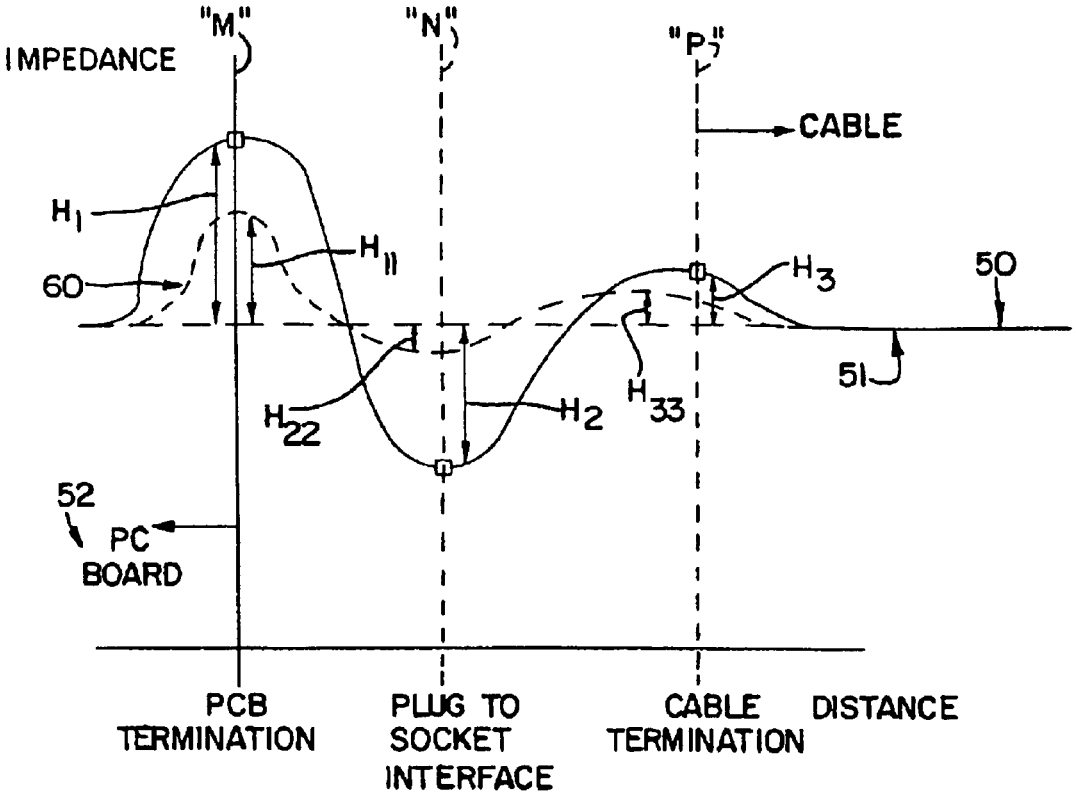
FIG. 11 is a diagram illustrating the typical impedance discontinuity experienced throughout a high-speed cable connection and also the reduction in this discontinuity that would be experienced with the connectors of the present invention.
Figure 12:
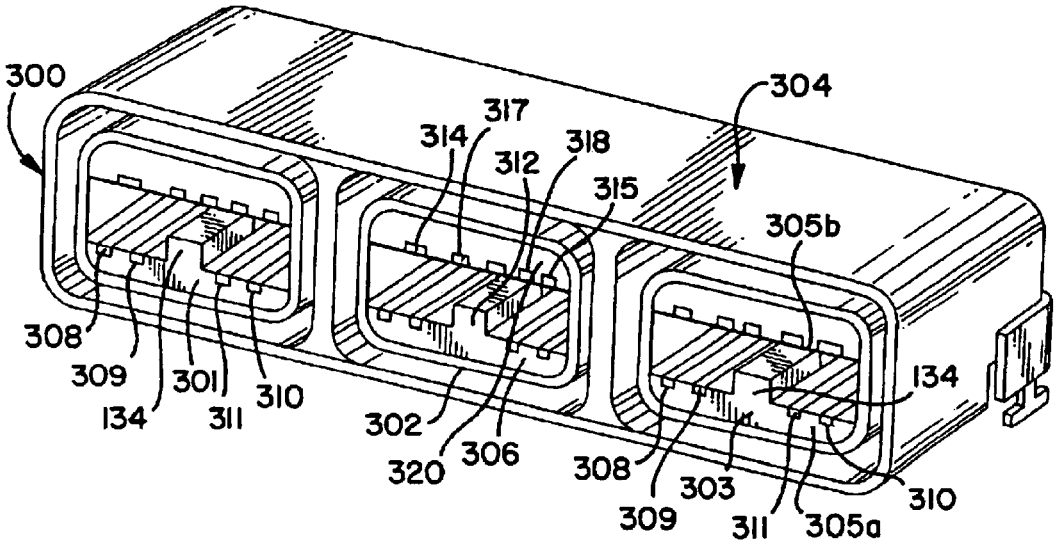
FIG. 12 is a perspective view of multiple socket-style connector in incorporating a plurality of triplet terminal arrangements in accordance with the principles of the present invention.

FIG. 11 illustrates the impedance discontinuity that occurs through a conventional plug and receptacle connector assembly used for signal cables. The impedance through the signal cable approaches a constant, or baseline value, as shown to the right of FIG. 11 at 51. This deviation from the baseline is shown by the solid, bold line at 50. The cable impedance substantially matches the impedance of the circuit board at 52 shown to the left of FIG. 11 and to the left of the "PCB Termination" axis. That vertical axis "M" represents the point of termination between the socket, or receptacle, connector and the printed circuit board, while the vertical axis "N" represents the interface that occurs between the two mating plug and socket connectors, and the vertical axis "P" represents the point where the plug connector is terminated to the cable.

The curve 50 of FIG. 11 represents the typical impedance "discontinuity" achieved with conventional connectors and indicates three peaks and valleys that occur, with each such peak or valley having respective distances (or values) $H_1$, $H_2$ and $H_3$ from the baseline as shown. These distances are measured in ohms with the base of the vertical axis that intersects with the horizontal "Distance" axis having a zero (0) ohm value. In these conventional connector assemblies, the high impedance as represented by $H_1$, will typically increase to about 150 ohms, whereas the low impedance as represented by $H_2$ will typically decrease to about 60 ohms. This wide discontinuity between $H_1$ and $H_2$ of about 90 ohms affects the electrical performance of the connectors with respect to the printed circuit board and the cable.

The present invention pertains to a connector and a connector termination structures that are particularly useful in I/O ("input-output") applications that has an improved structure that permits the impedance of the connector to be set so that it emulates the cable to which it is mated and reduces the aforementioned discontinuity. In effect, connectors of the present invention may be "tuned" through their design to improve the electrical performance of the connector.

Impedance Tunability

Figure 1A:
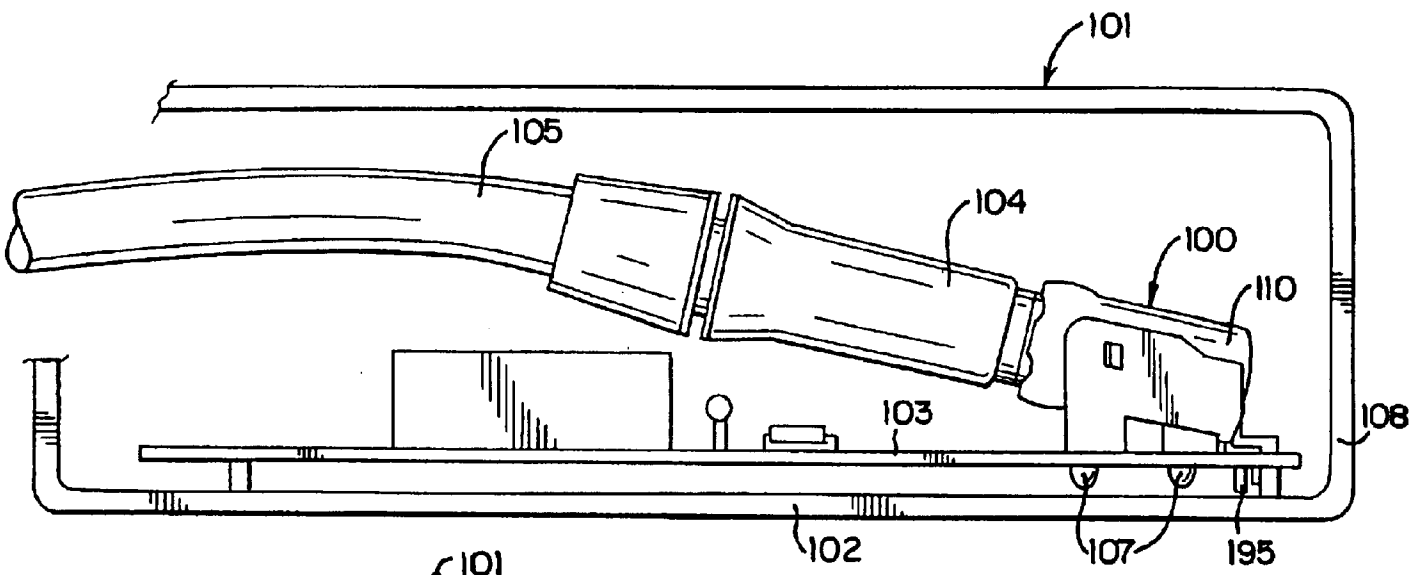
FIG. 1A is an elevational view of a cable connector assembly of the invention in place on a circuit board of an electronic device illustrating an "internal" environment in which the present invention has utility.
Figure 1B:
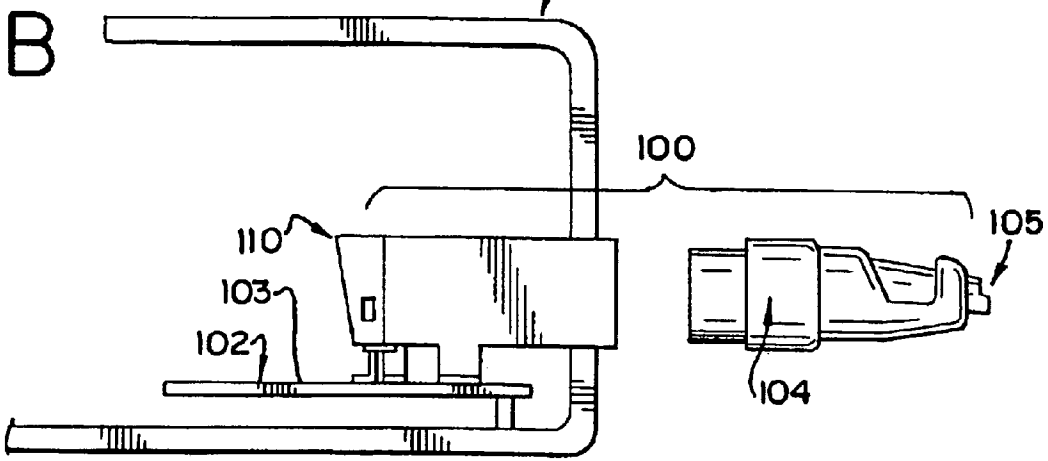
FIG. 1B is an elevational view of a cable connector assembly of the invention in place on a circuit board of an electronic device and extending to the exterior of the device to illustrate an "external" environment in which the present invention has utility.

Turning to FIG. 1A, one "internal" environment is depicted in which the present invention finds significant utility. In this environment, the connectors of the present invention are disposed inside of the exterior wall 108 of an electronic device, such as a computer 101. Hence, the reference to "internal." The connectors of the present invention may also be used in an "external" application, as illustrated in FIG. 1B, wherein one of the connectors 110 is mounted to the circuit board 102, but extends partly through the exterior wall 108 of the device 101 so that it may be accessed by a user from the exterior of the device 101. The connector assembly 100 includes a pair of first and second interengaging connectors, described herein as respective receptacle (or socket) connectors 110 and plug connectors 104. One of these two connectors 110 is mounted to the printed circuit board 102 of the device 101, while the other connector 104 is typically terminated to a cable 105 that leads to a peripheral device.

Figures 2, 3:
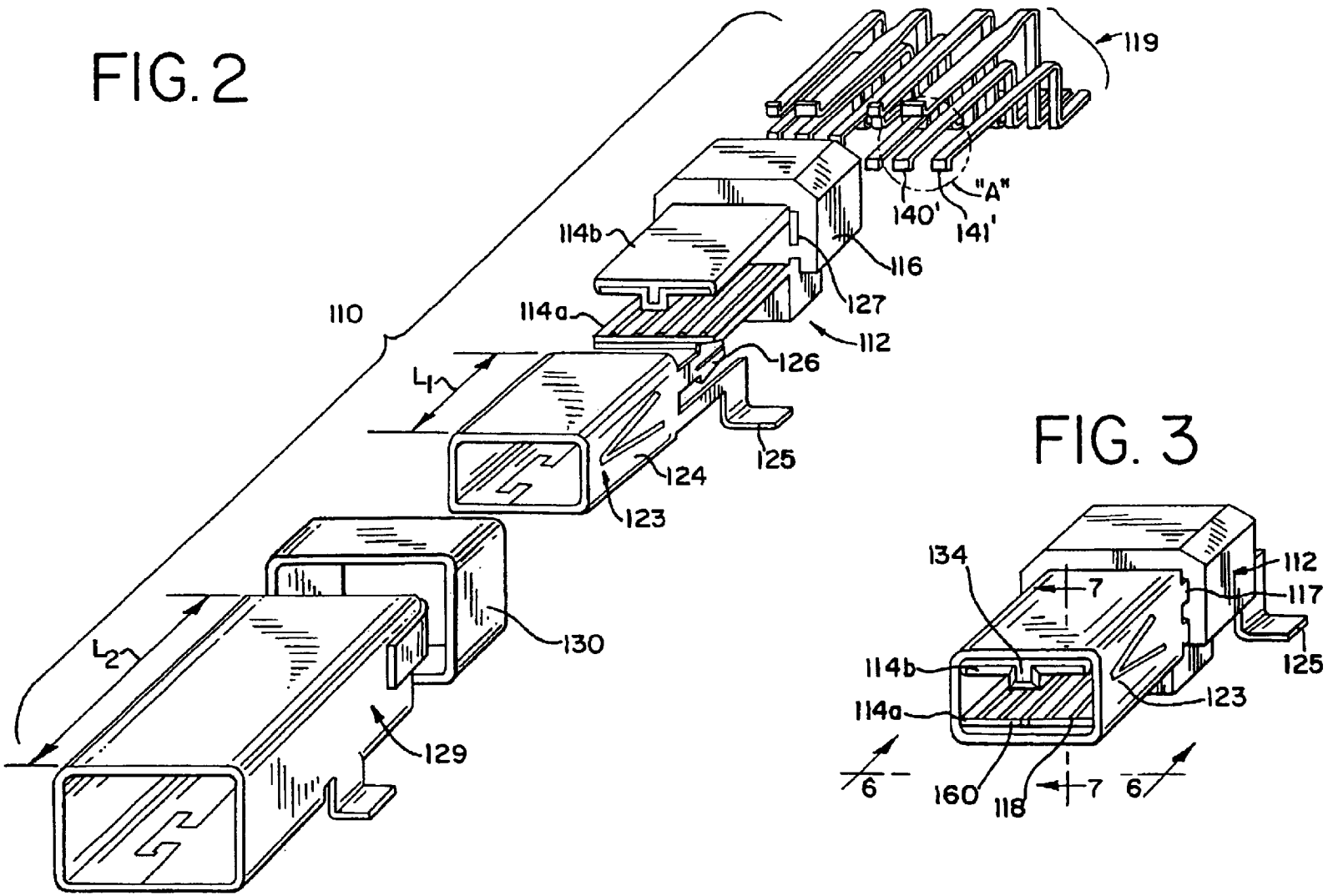
FIG. 2 is an exploded view of a cable connector in the form of a socket connection constructed in accordance with the principles of the present invention that is suitable for mounting onto a printed circuit board and opening to either the interior or exterior of the electronic device.
FIG. 3 is a perspective view of the socket connector and inner shield of the connector of FIG. 2.

FIG. 2 is an exploded view of a receptacle, or socket connector, 110 constructed in accordance with the principles of the present invention. The connector 110 is seen to include an insulative connector housing 112 that is formed from a dielectric material. In the embodiment depicted, the housing 112 has two leaf portions 114*a*, 114*b* that extend out from a body portion 116 of the housing 112. These housing leaf portions support a plurality of conductive terminals 119 as shown. In this regard, the lower leaf portion 114*a* has a series of grooves, or slots 118, formed therein that are adapted to receive selected ones of the conductive terminals 119 therein. The upper leaf portion 114*b*, has similar grooves 120 (FIGS. 6 & 7) that receive the remaining terminals 119 of the connector 110.

In order to provide overall shielding to the connector housing 112 and its associated terminals 119, the connector may include a first shell, or shield, 123 that is formed from sheet metal having a body portion 124 that encircles the upper and lower leaf portions 114*a*, 114*b* of the body portion 116. This first shield 123 may also include foot portions 125 for mounting to the surface 103 of the printed circuit board 102 and which provide a connection to a ground on the circuit board. Depending foot portions 107 may also be formed with the shield as illustrated in FIG. 1A for use in through-hole mounting of the connector 110, although surface mounting applications are preferred as shown in FIG. 1B. The first shield 123 may, as shown in FIG. 2, include retention members 126 that are received within and which engage slots 127 formed in the connector body portion 116.

The structure of the socket connector 110 illustrated in FIG. 2 permits it to be used in the "internal" application shown in FIG. 1, as well as in "external" applications where the connector 110 is mounted to the circuit board 102, but where the connector 110 extends partially through and is accessible from an exterior wall 108 of the electronic device.

In order to prevent accidental shocks that may occur when a cable plug connector is inserted into the socket of the receptacle connector 110, a second shield 129 may be provided that extends over the first shield 123 and which is separated therefrom by an intervening insulator element 130. The second shield 129 also has mounting feet 131 integrated therewith and will be connected to a chassis ground so that it is isolated from the circuit grounds. The second shield 129 preferably has a length $L_2$ that is greater than the length $L_1$ of the first shell so that it becomes difficult for user to contact the inner shield 123 when a cable connector is engaged with it.

As mentioned earlier, one of the objects of the present invention is to provide a connector having an impedance that more closely resembles that of the system (such as the cable) impedance than is typically found in multi-circuit connectors. The present invention accomplishes this by way of what shall be referred to herein as a tunable "triplet" or "triad," which is an arrangement of three distinct terminals shown at "A" in FIGS. 2, 5A, 5B & 6. In its simplest sense, and as shown in FIG. 5A, such a triplet involves two signal terminals 140, 141 and a single ground terminal 150 that are arranged to mate with corresponding terminals of the plug connector 104 that are terminated to the wires of a differential pair of wires (preferably a twisted pair of wires) TPA+, TPA−, shown schematically in FIGS. 9A & 9B which carry the same strength signals but which are complements of each other, i.e., +1.0 volts and −1.0 volts as well as a ground complement.

Figure 7:
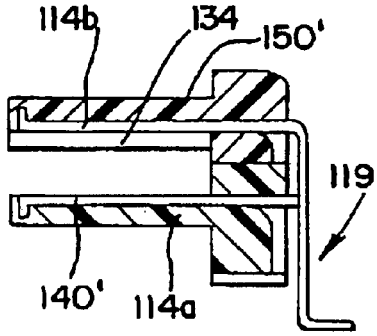
FIG. 7 is a cross-sectional view taken along lines 7—7 of FIG. 3, illustrating the receptacle connector body and the separation of the two rows of terminals thereof.
Figure 8A:
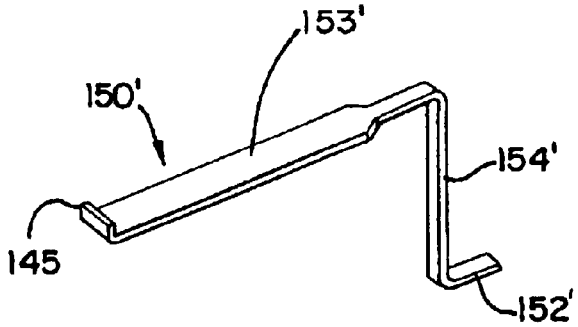
FIG. 8A is a perspective view of a ground terminal utilized in the receptacle connectors of FIGS. 2–3 and 6–7.
Figure 8B:
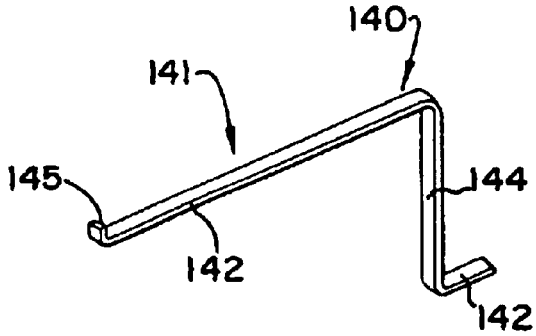
FIG. 8B is a perspective view of a signal terminal utilized in the receptacle connectors of FIGS. 2–3 and 6–7.

As shown best in FIG. 8B, the two signal terminals 140, 141 may have a cantilevered design where each terminal 140, 141 has a surface mount foot portion 142, a contact blade portion 143, and an interconnecting body portion 144. With this design, the terminals 140, 141 may be easily stamped and formed. The terminals 140, 141 are received within slots 118 of the lower leaf 114*b* of the housing body portion 116 and may include, as shown in FIGS. 2 & 7, endtabs 145 at the free ends of the contact blade portions 143 that are received in openings 117 formed in the connector housing body 116 at the ends of the slots 118. In order to "tune" the electrical characteristics of the connector and more closely resemble the impedance of the system, a single ground terminal 150 is provided in association with each set of differential signal terminals 140, 141. Hence, the term "triplet."

Figure 9A:
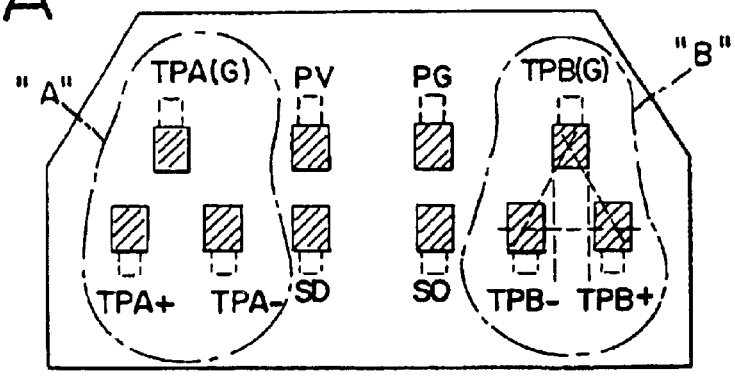
FIG. 9A is a schematic end view of the connectors of FIGS. 2–4 and 6–7, illustrating the arrangement of the various terminals relative to each other, and illustrating the use of two status information terminals.
Figure 9B:
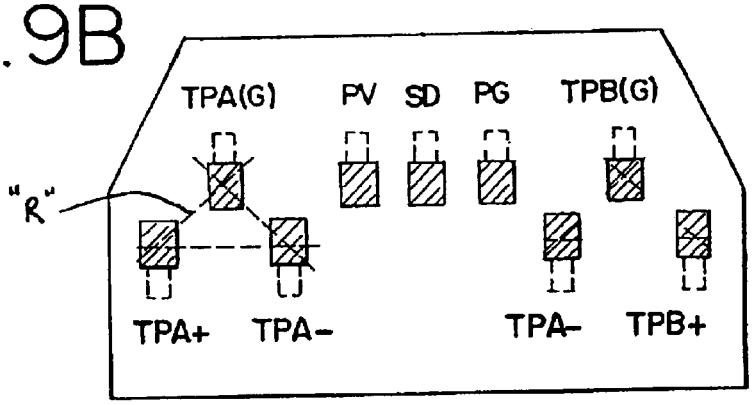
FIG. 9B is a schematic end view of the connectors of FIGS. 12–14 and 17 illustrating the arrangement and identification of the terminals and showing the use of one status information terminal.

Each such ground terminal, as shown in detail "A" of FIGS. 5A, 5B and 9A, 9B is associated with two differential signal terminals. The schematic diagrams of FIGS. 9A and 9B illustrate the triple terminal concept at "A" and "B". The signal terminals 140, 141 may be considered in one sense, arranged in a triangular fashion with respect to the ground terminal 150. They may also be considered in another sense as "flanking" the ground terminal inasmuch in some of the orientations discussed herein, portions of the signal terminals extend to a point somewhat exterior of the side edges of the ground terminal 150. In the embodiments illustrated, the ground terminal 150 is located on the upper leaf portion 114*b* of the receptacle connector body 116 and between the two signal terminals 140, 141. In the schematic diagrams shown in FIGS. 9A & 9B, two such triplets are shown in a triangular orientation, with the individual terminals being identified with either an "A" or "B" suffix. Thus, TPA+ and TPA− represent the terminals for the differential signal wires of the "A" pair of wires, while TPA(G) represents the ground terminal for the "A" set of wires. Likewise, TPB+ and TPB-represent the terminals of the differential signal wires of the "B" pair of wires in the cable, while TPB(G) represents the ground terminal of the "B" wire set. As described in more detail below, the triangular relationship among these three associated terminals may vary and include equilateral triangular relationships to isosceles triangular relationships and the like.

Figure 9C:
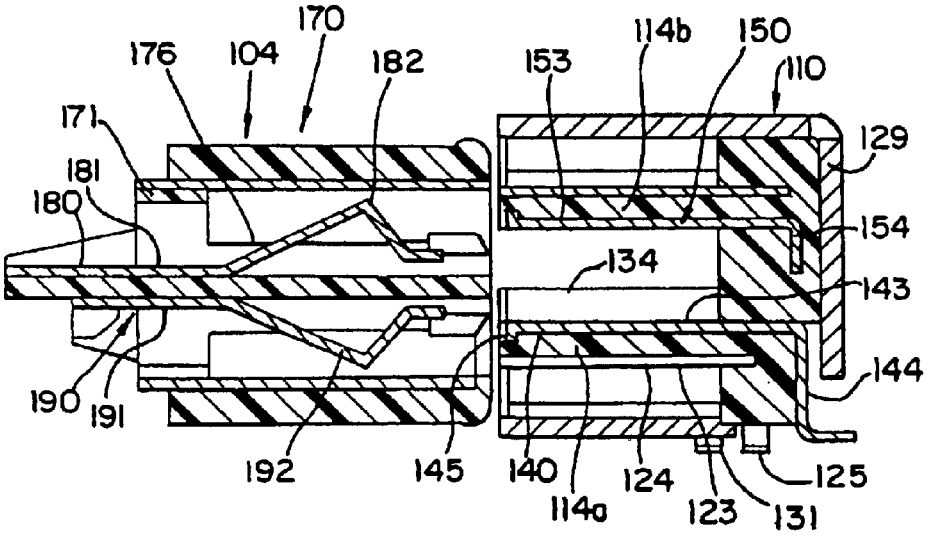
FIG. 9C is a cross-sectional view of two plug and receptacle connectors shown in preliminary engagement with each other.

The associated ground terminal 150, as shown in FIG. 8A, also has a cantilevered design with a surface mount foot portion 152, an intermediate body portion 154 and a contact blade portion 153. As with the signal terminals, the contact blade portion 153 of the ground terminal 150 lies in a different plane than that of its intermediate body portion 154. As seen best in FIGS. 2, 8A–8B and 9C, the contact blade portions 143, 153 of the signal and ground terminals lie in different, but intersecting planes than their respective terminal body portions 144, 154. Although the preferred embodiment illustrates these two planes as being generally perpendicular horizontal and vertical planes, it will be understood that such planes need not be perpendicularly intersecting or lying in exact horizontal and vertical planes to effect the advantages of the invention. It is desirable, however, that the two planes intersect with each other. The contact portions of the signal and ground terminals extend through substantially all of the connector housing as shown in FIG. 9C, from a point where they enter the housing to at least near the front endface of the connector. The triangular orientation of the three terminals is preferably maintained throughout the connector housing.

Still further, the surface mount portions 142, 152 of the signal and ground terminals 140, 141, 150 may lie in a plane generally parallel to that of their respective contact blade portions 143, 153. The mounting portions of the signal and ground terminals may also utilize through-hole members 195 (FIG. 1A) for mounting purposes. The interaction between the surface area and location of the ground and signal terminals is explained below.

Figure 13:
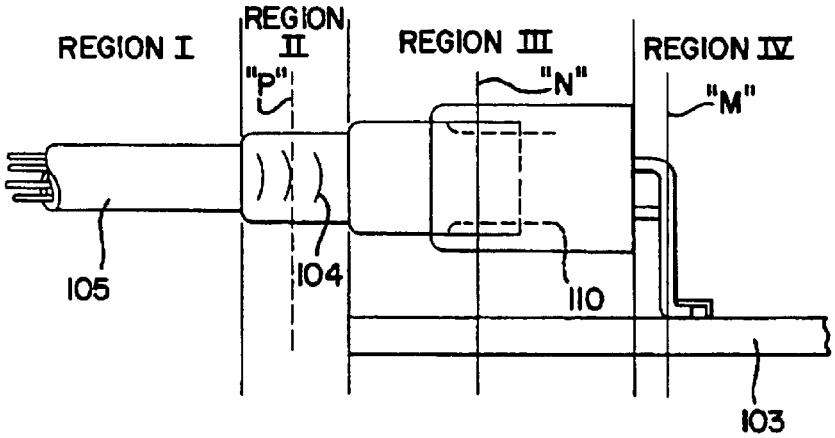
FIG. 13 is a schematic view of the connector interface area between a cable and board connector.

By this structure, each pair of the differential signal terminals of the cable or circuit have an individual ground terminal associated with them that extends through the connector, thereby more closely resembling both the cable and its associated plug connector from an electrical performance aspect. Such a structure keeps the signal wires of the cable "seeing" the ground in the same manner throughout the length of the cable and in substantially the same manner through the plug and receptacle connector interface and on to the circuit board. This connector interface is shown schematically in FIG. 13, and may be considered as divided into four distinct Regions, I–IV, insofar as the impedance and electrical performance of the overall connection assembly or system is concerned. Region I refers to the cable 105 and its structure, while Region II refers to the termination area between the cable connector 104 and the cable 105 when the cable is terminated to the connector. Region III refers to the mating interface existent between the cable connector and the board connector 110 that includes the mating body portion of the connectors 104, 110. Region IV refers to the area that includes the termination between the board connector 110 and the circuit board 103. The lines "P, N, and M" of FIG. 11 have been superimposed upon FIG. 13.

The presence of an associated ground with the signal terminals importantly imparts capacitive coupling between the three terminals. This coupling is but one aspect that affects the ultimate characteristic impedance of the terminals and their connector. The resistance, terminal material and self-inductance are also components that affect the overall characteristic impedance of the connector insofar as the triplet of terminals is concerned. In the embodiment shown in FIG. 5B, the width $D_2$ of the ground terminal blade portion 153' is large enough so that it extends over, or at least partially overlaps portions of the signal terminals 140', 141'. Preferably, in instances such as that represented in FIG. 5B, a portion of the ground terminal 150' always overlies or overlaps, a portion of at least one of the signal terminals, 140', 141'. In other instances, such as that represented by FIG. 5A, the ground terminal 150 may lie between or abut imaginary lines S drawn up from the side edges of the signal terminals 140, 141. The larger width $D_2$ of the ground terminal blade portion 153' has a consequent larger surface area compared to the surface areas of the signal terminal contact blade portions 143' and hence, the ground terminal blade portion 153' presents a larger and overlapping contact mating area in the region above the signal terminals 140', 141'.

Figure 14:
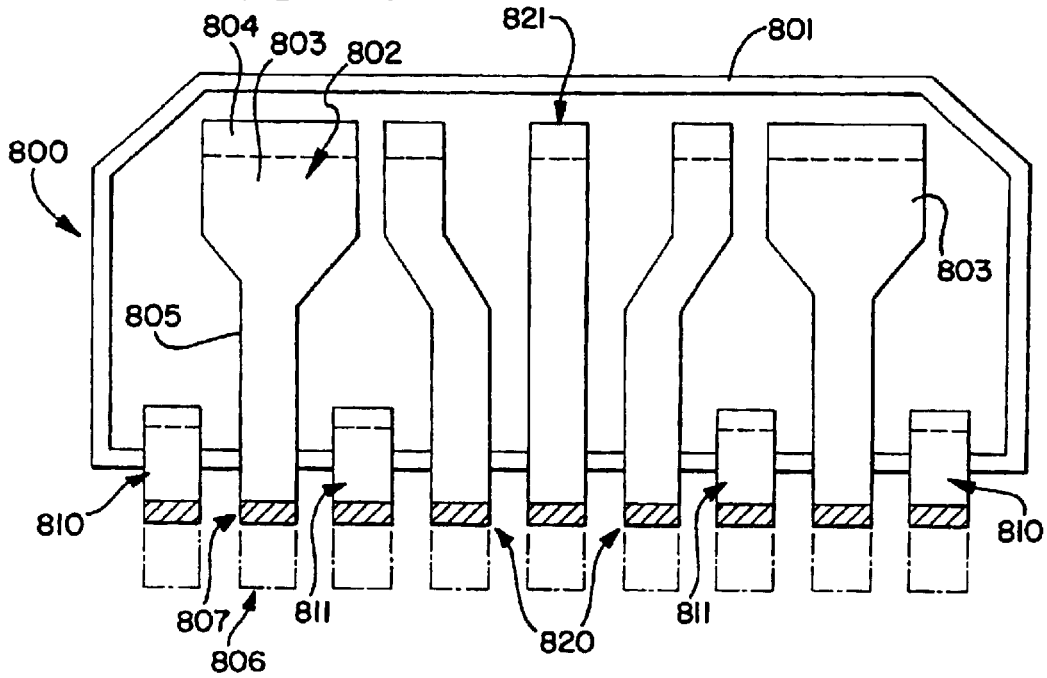
FIG. 14 is a diagrammatic view taken from the rear end of another board connector constructed in accordance with the principles of the present invention, and illustrating the arrangement of the terminals in their extent from the circuit board to the mating contact area.
Figure 15:
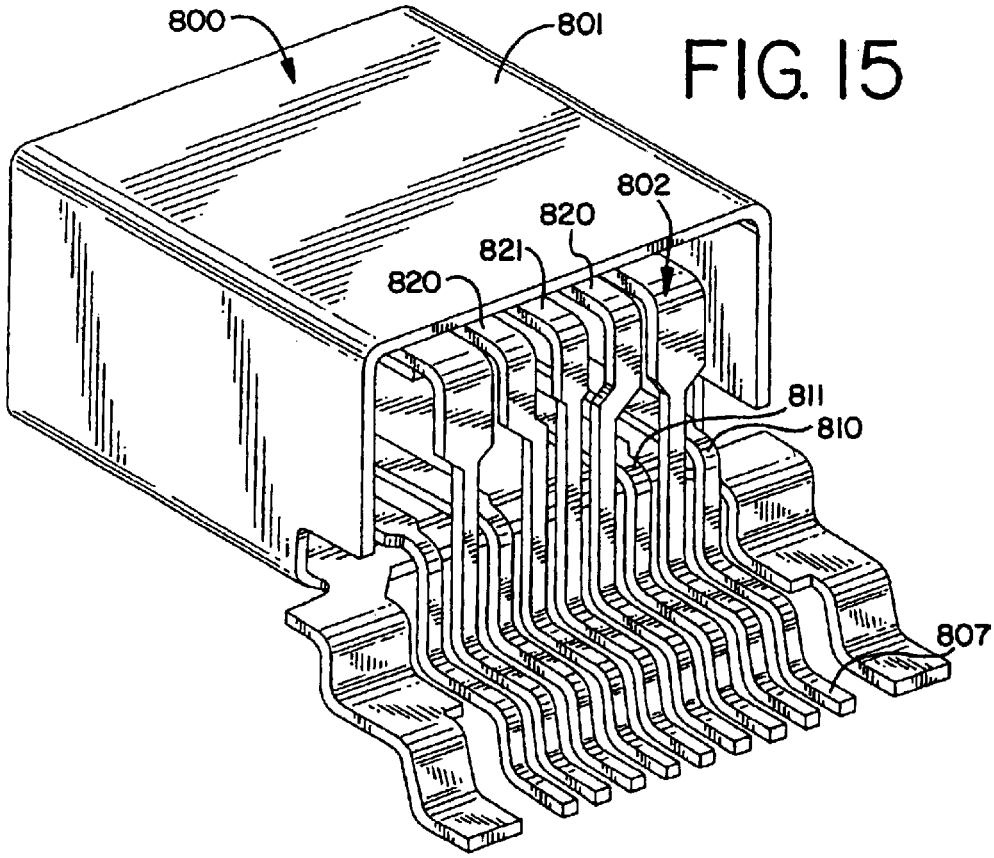
FIG. 15 is a perspective view of the connector of FIG. 14 illustrating the terminals thereof set in place within a shield member prior to the molding of a dielectric insert portion thereto.

In order to preserve the small "footprint" of the receptacle connector 110 on the circuit board, the present invention, in the embodiment shown, may reduce the width of the ground plane in the ground terminal body portion 154' as well as in the surface mount foot portions 152'. For the most part, the width of the ground terminal in the mounting portions 152' will be the same and in some instances as illustrated in FIGS. 14 & 15, the width of the ground terminal body portion may be increased. By reducing the width of the ground terminal 150' in its body portion 154' in the second plane thereof so that it may fit between the differential signal terminals, the distance between the signal terminals (TPA+ and TPA−) is also reduced to maintain a like capacitive coupling through the connector by maintaining a preselected substantially constant impedance between the ground terminal and the signal terminals. The impedance of the connector (as well as the coupling between the terminals) is affected by the spacing between the adjacent signal terminals 140', 141' as well as between the signal and ground terminals. Still further, the material used between the terminals, such as air, the housing material, or a combination of both, will present either a dielectric constant or a composite dielectric constant in the areas between the signal and ground terminals.

Figure 5B:
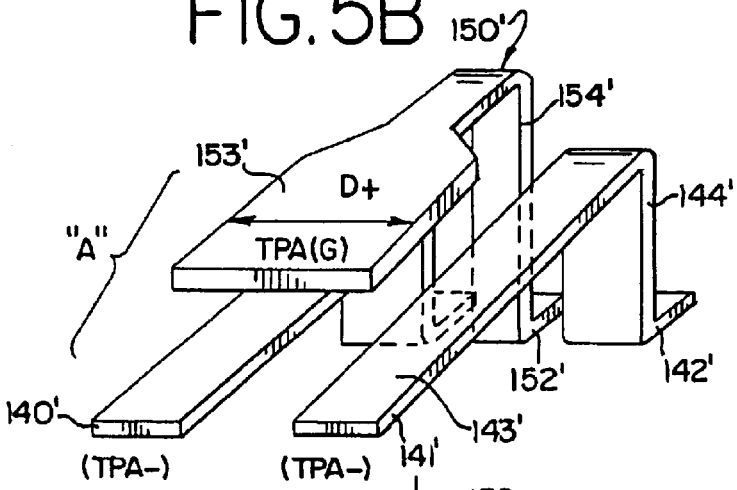
FIG. 5B is an enlarged detail view of another type of terminal triplet that may be used in the connector of FIG. 2.
Figure 5A:
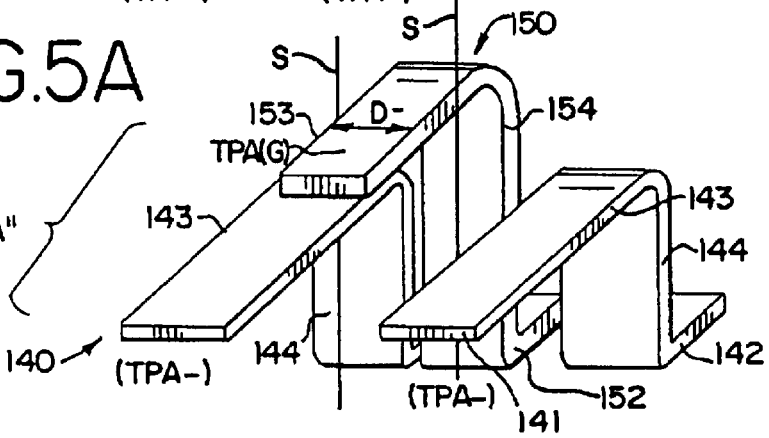
FIG. 5A is an enlarged detail view of a group of three terminals arranged in a "triplet" and used in the connector of FIG. 2 illustrating the relative size and placement of the two signal terminals and one ground terminal thereof.

By reducing the width of the ground terminal body portion 154' in the embodiment of FIG. 5B, the overlapping aspect between the contact blade portions 153', 143' of the ground and signal terminals stops in a first plane (shown as horizontal), but no longer overlap in the second, intersecting (vertical) plane. Rather, in this second plane the ground terminal body portion 154' may be aligned with the signal terminals 144' in an edge-to-edge arrangement. Although there is less cross-sectional area of the ground terminal in these planes, the ground terminal is now closer to the signal terminals and hence like coupling between the terminals is maintained.

In the region of the first plane, namely that of the ground and signal terminal contact blade portions which lie in the mating interface of Region III of FIG. 18, the overall plate size of the ground terminal 150' is increased relative to that of the signal terminals 140', 141' to thereby selectively diminish the impedance as referred to above. Likewise, in the second plane, occupied by both the signal ground terminal body portions 144', 154', the spacing between the ground terminal 150' and the signal terminals 140', 141' is reduced so that the ground and signal terminals are brought closer together to thereby reduce the impedance of the connector. The signal ground terminal contact blade portions 143, 143' of the triplets are preferably maintained in the same plane as illustrated in FIGS. 5A & 5B, and along the lower leaf portion 114*a* of the connector housing 112. This notably permits the impedance of the connector to be tuned from a spacing aspect but also facilitates the mechanical engagement of the two connectors. By providing a ground terminal with a larger contact blade portion, the mating contact between such terminals and the opposing ground and signal terminals of the other (plug) connector is improved without detrimentally affecting impedance.

The effect of this tunability is explained in FIG. 11, in which a reduction in the overall impedance discontinuity occurring through the connector assembly is demonstrated. The impedance discontinuity that is expected to occur in the connectors of the present invention is shown by the dashed line 60 of FIG. 11. The solid line of FIG. 11 represents the typical impedance discontinuity that is experienced in the connector system of FIG. 13. By comparing the dashed and solid lines, the magnitudes of the peaks and valleys of this discontinuity, $H_{11}$, $H_{22}$ and $H_{33}$ are greatly reduced. The present invention is believed to significantly reduce the overall discontinuity experienced in a conventional connector assembly. In one application, it is believed that the highest level of discontinuity will be about 135 ohms (at $H_{11}$) while the lowest level of discontinuity will be about 85 ohms (at $H_{22}$). The target baseline impedance of connectors of the invention will typically be about 110 ohms with a tolerance of about +/−25 ohms. It is contemplated therefore that the connectors of the present invention will have a total discontinuity (the difference between $H_{11}$ and $H_{22}$) of about 50 ohms, which results in a decrease from the conventional discontinuity of about 90 ohms referred to above of as much as almost 50%.

Figure 6:
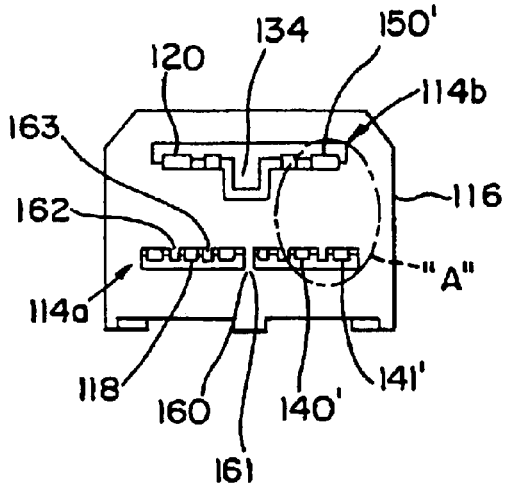
FIG. 6 is an end view taken along lines 6—6 of FIG. 3, but illustrating only the internal insulative body of the receptacle connector of FIG. 3.

The tunability and impedance characteristics may also be affected, as stated earlier by the dielectric between the terminals. In this regard, and as shown best in FIG. 6, the lower leaf portion 114*a* of the connector housing 112 may itself be slotted, as at 160 to form an air gap 161 between halves of the lower leaf portion 114*a*. Likewise, the signal (and other) terminals 140, 141 or 140', 141' may be separated from each other on the lower leaf portion 114*a* by a similar air gap 162 that is defined by a channel 163 formed in the lower leaf portion 114*a*. These channels 163, as seen in FIG. 6, extend only partially through the thickness of the lower leaf portion 114*a* so as to preserve the structural integrity of the lower leaf portion.

Figure 4:
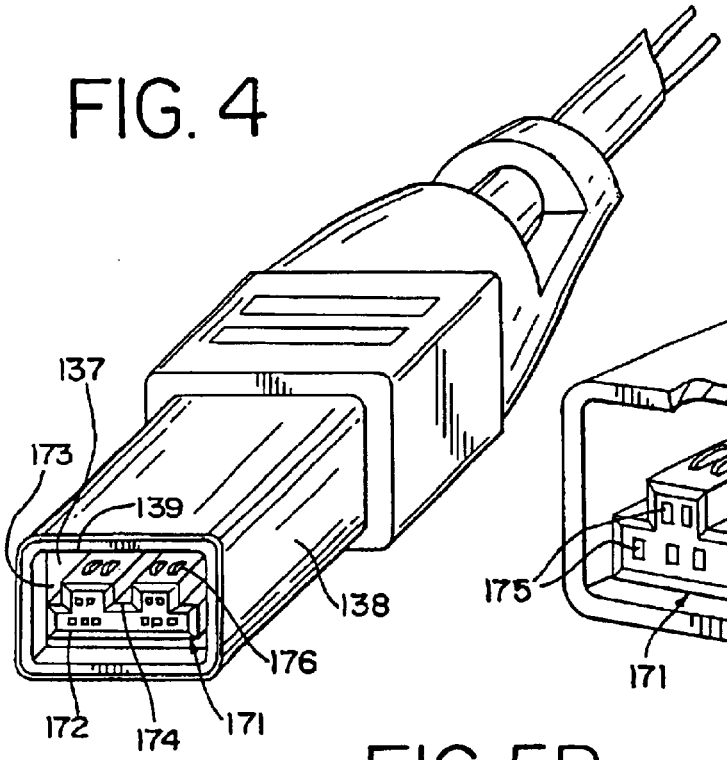
FIG. 4 is a perspective view of a cable with a plug connector terminated thereto for engagement with the socket connector of FIG. 2.
Figure 4A:
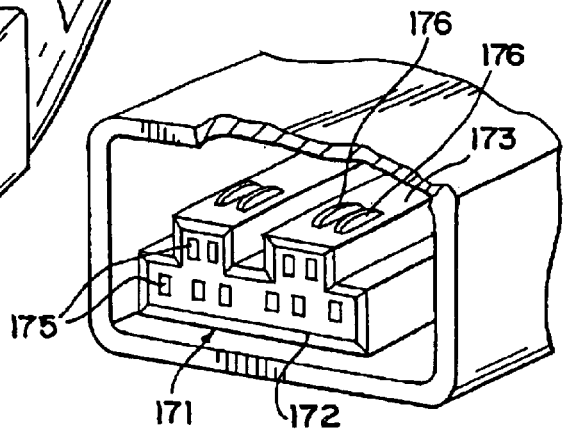
FIG. 4A is an enlarged end view of the plug-style connector of FIG. 4, with a portion of the connector cover broken away to better illustrate the terminal structure and location thereof.

Turning now to FIGS. 4 and 4A, an opposing mating connector 104 is shown in the form of a plug connector 170 that has an insulative connector housing 171 formed from a dielectric material in a complimentary configuration to that of the receptacle connector 110 so as to facilitate and ensure the proper mating therebetween. In this regard, the connector housing 171 has a base portion 172 with two portions 173 that extend therefrom and which are separated by a gap 174 that serves as a keyway in the receptacle connector housing body key 134. This key 134 of the receptacle connector may be found on the upper leaf portion, as shown in FIGS. 2, 3, 6 and 7, or it may be formed on the lower leaf portion thereof as shown in FIGS. 9C and 17. The housing is hollow and contains signal, ground and other terminals held in internal cavities of the housing 171 (not shown).

Figure 10A:
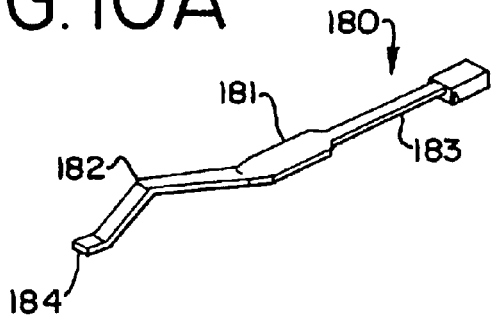
FIG. 10A is a perspective view of a ground terminal used in the plug-style connectors of the invention shown in FIGS. 4 and 12–14.
Figure 10B:
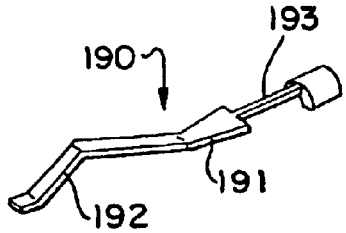
FIG. 10B is a perspective view of a signal terminal utilized in the plug-style connectors of the invention shown in FIGS. 4 and 12–14.

Two terminals are shown in FIGS. 10A and 10B which are representative of the type of terminal structure that is preferred for use in the plug connector 110. FIG. 10A illustrates a ground terminal 180 having a flat body portion 181 that interconnects a contact portion 182 to a wire termination portion 183. The terminal 180 has a free end 184 which is received in a cavity 175 at the end of the connector housing 171. The contact portion 182 is bent at an upward angle so that it will project out of a contact opening 176 in alignment with and in opposition to a corresponding ground terminal 150, or 150', of the receptacle connector 110.

The signal terminal 190 (FIG. 10B) is likewise structured and has a body portion 191 with a reduced width compared to that of the ground terminal body portion 181 in order to effect coupling between the signal and ground terminals. The body portion 191 interconnects a contact portion 192 with a termination portion 193 and the contact portion 192 is also bent at an angle to protrude through a corresponding opening 176 in the connector housing 171. These openings and the terminal contact portions appear on the lower surface of the connector base portion 172 as shown in FIG. 9C, and they are aligned with the terminal free end cavities 175 that are shown in the front face of the connector housing 171.

The grounded signal terminals 180, 190 of the plug connector 170 (as well as the other terminals) may be considered as "movable" contacts in that they are deflected toward the center of the plug connector housing 171 when the plug connector 170 is engaged with the receptacle connector 110. The grounded signal terminals 140, 141, 150 (as well as the other terminals) may be considered as "fixed" terminals because they do not move during engagement and disengagement of the two connectors. In the schematic views of FIGS. 9A and 9B, the solid rectangles represent the "movable" terminals described above, while the dashed adjacent rectangles represent the "fixed" terminals as described above. These Figures, along with FIGS. 5A and 5B illustrate the triangular relationship of the differential signal wires TPA+, TPA− with their associated ground terminal TPA(G). Each such terminal may be considered as defining a vertex of a triangle that is formed when imaginary lines are drawn interconnecting adjacent terminals as shown by the dashed lines R in FIG. 9B. In this description and in the execution of the invention, the ground terminal may be considered as being the apex, or "tip" of the imaginary triangle.

In a manner consistent with that set forth above with respect to the board connector and its signal and ground terminals 140, 140', 141, 141' and 150, 150', the terminals 180, 190 of the cable connector 170 are also structured to provide a desired impedance by way of their shapes and by way of the aforementioned triangular relationship.

As shown in FIGS. 10A and 10B, the ground and signal terminals 180, 190 each have respective contact portions 182, 192 that engage opposing contact portions 153, 143 of the ground and signal terminals 150, 140 of the opposing board connector 110. As shown in FIG. 9C, these cable connector terminal contact portions 182, 192 have a length approximately equal to the corresponding lengths of the terminal contact portions 153, 143 of the board connector 110. As might be expected, the widths and surface areas of the cable connector ground terminal contact portion 182 need not be increased because when the two connectors 110, 170 are engaged together, the geometry of the board connector contact portions 153, 143 will dominate the mated connectors and the impedance formed as a result of the mating engagement that occurs in Region III in FIG. 13.

In order to continue this desired impedance and electrical performance, as shown in FIGS. 10A and 10B and as explained above, the interconnecting body portion 181 of the ground terminal 180 is larger and preferably wider than one or both of the two signal terminal interconnecting body portions 191. This increase in width increase the surface area of the ground terminal at that area, i.e., the body portion of the connector, which increases capacitive coupling among the ground terminal 180 and its two associated signal terminals 190.

As shown in FIG. 9C, these terminals 180, 190 are also spaced apart along their contact portions 182, 192, along their body portions 181, 191 and, as illustrated by the solid rectangles of FIGS. 9A and 9B, are arranged in a triangular relationship with the cable connector ground terminal 180, and being located at the apex of the triangle. It can be seen that this triangular relationship will continue and maintain the electrical balance of the connector system throughout the interface, from the circuit board to the cable. In the preferred execution of the invention for this embodiment, the width of the ground terminal body portion 181 is preferably twice as wide as any single corresponding signal terminal body portion 191. The body portion 191 of the signal terminal 190 in FIG. 10B is shown as having a somewhat slight triangular configuration at its rear part. This specific portion serves to provide engagement points with the connector housing 171 to hold the terminals 190 in the connector housing 171 after molding. With this difference in terminal geometries, the width and surface area relationships of the board connector 110 may be likewise maintained in the cable connector 105.

The dimensions and configuration of the termination portions of the cable connector terminals 180, 190 may also be structured to not only maintain the beneficial electrical relationship established within both the cable 105 and the cable connector 104, but also to maintain the approximate geometry of the cable 105 in the connector termination area and to facilitate the termination of the cable 105 to such a connector 104.

Figure 16:
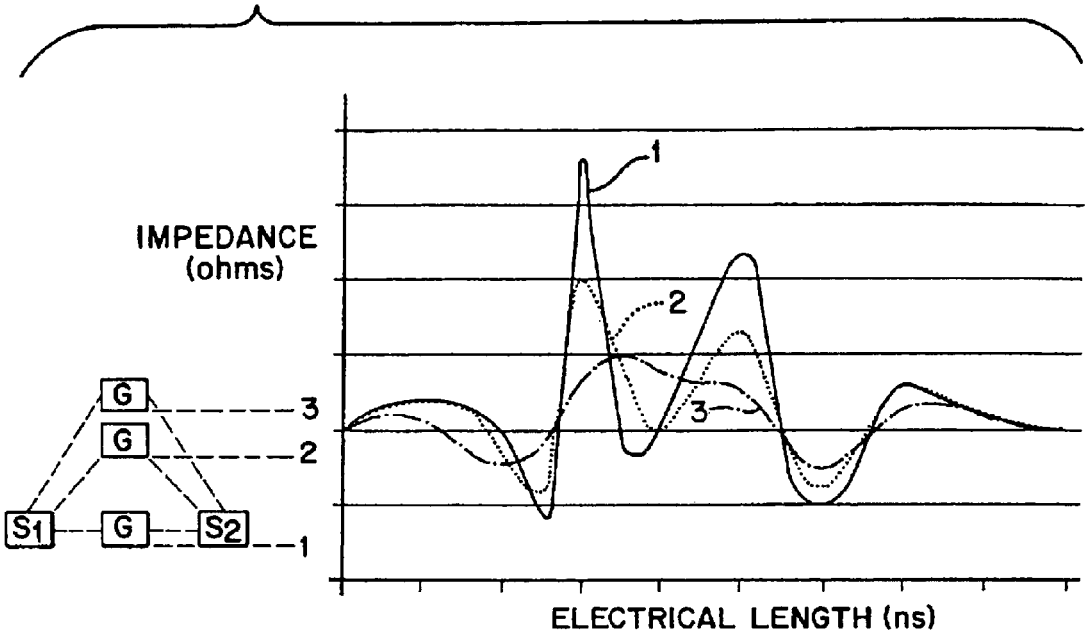
FIG. 16 is a diagram illustrating the impedance profile that is expected to occur through Regions I through IV of FIG. 13 illustrating how such a profile changes as the system ground terminal is moved from the same level as two associated signal terminals.

By manipulating the distance between the ground and signal terminals of the board connector, the impedance of the system, and particularly the board connector may be changed, or "tuned." This is done because capacitive coupling occurs between the two signal terminals of the connector and the ground terminal. The spacing of the terminals also affects the impedance of the system. This relationship is best shown in FIG. 16, which displays the impedance profile that one would expect to obtain with the system of the invention where the impedance is charted as a function of the distance of the ground terminal G from the baseline along which the two associated signal terminals $S_1$ and $S_2$ of the system lie. The first such plot is shown in solid line and indicated at "1" to the left of FIG. 16. In this plot, the ground terminal G is level with its two associated signal terminals $S_1$ and $S_2$ as would be found in a conventional single row arrangement within a connector.

The second plot of interest in FIG. 16 is indicated at "2" and is shown by way of a dotted line, which represents the impedance values that are expected to occur when the ground terminal G is moved up from the initial level it shared with the two signal terminals $S_1$ and $S_2$. In this plot, it can be seen that the two peaks have been reduced as well as the interconnecting dip. Moving the ground terminal G, to its preferred distance as indicated by "3" to the left of FIG. 16. This plot is indicated by a dotted and dashed line. In this plot, it can be seen that the two peaks are substantially flattened and the interconnecting dip has been raised so as to smooth over the impedance curve and reduce the sharp and abrupt peaks and valleys.

In the optimum separation as represented by "2" in FIG. 16, the triangular relationship among the three signal and ground terminals approximates an equilateral triangle, while the middle separation indicated at "2" displays a triangular relationship that approximates an isosceles triangle. Other triangular relationships may be also utilized.

Figure 17A:
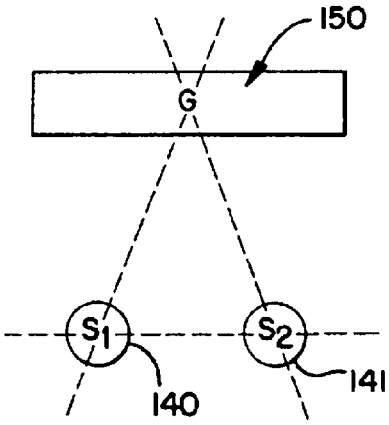
FIG. 17A is a schematic sectional view illustrating an alternate triangular arrangement of a "triple" of associated ground and signal terminals.
Figure 17B:
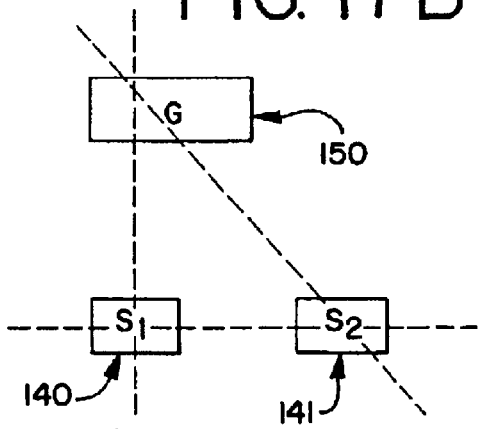
FIG. 17B is another schematic sectional view illustrating a triangular arrangement of three terminals in accordance with the present invention and approximating a right triangle; and, FIG. 17C is another schematic sectional view illustrating a triangular terminal arrangement in accordance with the invention approximating a scalene triangle and illustrating all three terminals each in a different plane.
Figure 17C:
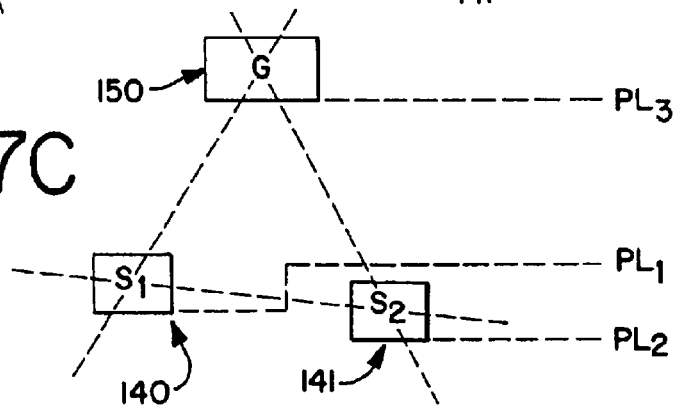

Other such relationships are illustrated in FIGS. 17A through 17C. In FIG. 17A, a triangular arrangement of terminals that includes one ground terminal 150 and two signal terminals 140, 141 is illustrated but where the signal terminals take the form of wires or other round shapes as opposed to flat, rectangular terminals. In this arrangement, imaginary lines drawn through the terminals (shown as dashed lines) will define an imaginary triangle. In FIG. 17B, the imaginary lines are drawn through the centers of the terminals 140, 141 and 150 and approximately define an imaginary right triangle.

Similarly, the imaginary lines are drawn through the terminals again, but an approximate scalene triangle is defined. The signal terminals 140, 141 of FIG. 17C may differ in their orientation to each other and may lie in different horizontal planes, $PL_1$ and $PL_2$ from each other as well as the plane $PL_3$ in which the ground terminal 150 is disposed. In this type of terminal orientation, the structure of the connector housing may be modified to define two different rows that will support the signal terminals. With such a structure the difference in level between the two signal terminals may permit the incorporation of a "keying" aspect for the connector that utilizes the terminal level differences.

In shall be understood that these illustrations are merely exemplary of the many different triangular presentations which the connectors of the present invention may take.

The widths of the ground and signal terminals also affects the coupling and the impedance of the system, which also includes the resistance of the terminals, which in turn is also a function of the dimensions of the terminals. Previously, as shown in FIG. 5B, the contact portion 153 of the ground terminal 150 has been shown as having an increased width, or surface area as compared to the contact portions 143 of the two associated signal terminals 140, 141. The width of the ground terminal may also be increased in other portions thereof.

Turning now to FIG. 14, the rear end of a board connector of the invention is shown generally at 800. The connector 800 has an outer shell or wall 801, through which a series of conductive terminals extend. Two sets of "triples" are shown in this embodiment, and each such triple includes a ground terminal 802 and two associated signal terminals 810, 811. Other terminals, such as power and status terminals 820, 821, may also be included. These terminals all enter into the connector from the rear endface thereof, and then a suitably insulative material is then molded around it to form the connector.

The ground terminals shown in FIG. 14 have a contact or mating portion 804 that extends in a cantilevered fashion from a terminal body or transition portion 805 and the transition portions 805 may extend until they meet mounting portions, which may be either surface mount mounting portions 807 as explained above, or through hole mounting portions 806. In this type of connector structure, the width of the ground terminals in the connector 800 may be increased along their extent to provide a greater surface area of the ground terminal 802 and present the same to its two associated signal terminals 810, 811.

FIG. 15 illustrates the connector of FIG. 14 in a surface mount application and also illustrates how the increased width body, or transition, portions of the ground terminal 802 may be aligned with the body or transition portions of the signal terminals so as riot to unduly increase the size and overall "footprint" of the connector 800.

While the preferred embodiments of the invention have been shown and described, it will be apparent to those skilled in the art that changes and modifications may be made therein without departing from the spirit of the invention, the scope of which is defined by the appended claims.

We claim:

1. A connector for providing a connection between a mating connector and a circuit board, the mating connector having at least one differential pair of signal terminals and a ground associated with said differential pair of signal terminals, the connector comprising:

a connector housing formed from an electrically insulative material, a triad of conductive terminals disposed in said housing, said triad including one ground terminal and two differential signal terminals associated with said ground terminal, each of said ground and signal terminals including a contact portion for contacting a corresponding opposing terminal of said mating connector, and a mounting portion for terminating said terminals to associated circuits on said circuit board, the ground and signal terminal contact portions at least partially supported within the connector housing and said ground and signal terminal mounting portions at least partially extending out of said connector housing, said ground and signal terminal contact portions being spaced apart from each other within said connector housing, and extending within said housing in a triangular orientation, said ground terminal having a width that increases from a first preselected width in said mounting portion thereof to a second preselected width in said contact portion thereof that is greater than said first preselected width, and, wherein said ground and signal terminal contact portions extend in respective first and second planes, and said ground and signal terminal mounting portions extend in a direction that intersects the first and second planes.

2. The connector as set forth in claim 1, wherein said ground and signal terminal contact portions define vertices of an imaginary triangle when three imaginary lines are drawn interconnecting said ground and signal terminals contact portions.

3. The connector as set forth in claim 1, wherein said ground and signal terminal contact portions extend horizontally through said connector housing and said ground and signal terminal mounting portions extend vertically from said connector housing.

4. The connector as set forth in claim 1, wherein said ground terminal and said first and second signal terminals are disposed in a triangular configuration lengthwise through said connector, with each of said terminals defining a vertex of an imaginary triangle.

5. An I/O connector assembly for effecting a connection between first and second electronic components, the components each including at least one differential pair of signal circuits and an associated ground circuit, the connector assembly comprising:

first and second connectors, each of the first and second connectors having respective first and second connector housings, each of said first and second connector housings having opposing mating and terminating regions, said first connector being terminated to the first electronic component at said terminating region thereof and said second connector being terminated to the second electronic component at said terminating region thereof, said first and second connectors being engagable at said mating regions thereof, thereby effecting said connection between said first and second electronic components, each of said first and second connectors including a ground terminal associated with a positive differential signal terminal and a negative differential signal terminal, said ground and signal terminals engaging each other when said mating regions of said first and second connectors are engaged together, each of said ground and signal terminals of said first connector having contact portions, mounting portions, and body portions interconnecting said contact and mounting portions together, said signal terminal contact portions being horizontally spaced apart from each other, said ground terminal contact portion being vertically spaced apart from said signal terminal contact portions, said ground and signal terminal body portions intersecting said contact portions of said ground and signal terminals such that said ground and signal terminal contact and body portions extend at angles to each other.

6. The I/O connector assembly of claim 5, wherein said body portions of said ground and signal terminals all lie in the same plane.

7. The I/O connector assembly of claim 5, wherein said ground signal terminal contact portion is contiguous.

8. The I/O connector assembly of claim 5, wherein a width of said ground terminal contact portion is greater than a corresponding width of each of said signal terminal contact portions.

9. The I/O connector assembly of claim 5, wherein said signal and ground terminal contact portions of each of said first and second connectors are arranged in a triangular orientation with said first and second connector mating regions.

10. A connector for providing a connection between first and second electronic components, each component having at least one differential pair of signal circuits and an associated ground circuit, the connector comprising:

a connector housing formed from an electrically insulative material, a triplet of conductive terminals supported by said housing, said triplet including a distinct arrangement of two differential signal terminals and one associated ground terminal, each of said triplet terminals including a contact portion that is at least partially supported by said housing for contacting a respective terminal contact portion of an opposing terminal of a mating connector, a connecting portion for connecting said terminals to associated circuits, and an intervening body portion that interconnects said contact portion and said connecting portion together, said triplet terminal contact portions and said body portions being angled with respect to each other, said ground terminal contact portion being wider than any one of said two signal terminal contact portions, said contact portions of said two signal terminals of said triplet being spaced apart from each other and disposed in side-by-side order along said connector housing, said triplet ground terminal contact portion being spaced apart from said two signal terminal contact and said triplet ground terminal body portion being spaced apart from said triplet two signal terminal body portions.

11. The connector of claim 10, wherein said triplet ground terminal contact portion is contiguous.

12. The connector assembly of claim 10, wherein a width of said triplet ground terminal contact portion is greater than a corresponding width of each of said contact portions of said two signal terminals of said triplet.

13. A connector assembly for providing a connection between first and second electronic components, each component having at least one differential pair of signal circuits and an associated ground circuit, the connector assembly comprising:

first and second connectors, each connector having a housing formed from an electrically insulative material, a triplet of conductive terminals supported by said housing, said triplet including a distinct arrangement of a positive differential signal terminal, a negative differential signal terminal and an associated ground terminal, each of said triplet terminals including a contact portion formed in a mating region of said connector for contacting a respective terminal contact portion, a connecting portion for connecting said terminals to associated circuits, and an intervening body portion that interconnects said contact portion and said connecting portion together, said triplet terminal contact portions lying in a different but intersecting plane than that of its respective body portion, said contact portions of said two signal terminals of said triplet being spaced apart from each other in a first direction and disposed in side-by-side order along said connector housing, said triplet ground terminal contact portion being spaced apart in a second direction from said two signal terminal contact portions and aligned therewith, said triplet ground terminal body portion being spaced apart from said triplet two signal terminal body portions.

14. The connector assembly of claim 13, wherein said body portions of said ground and signal terminals all lie in the same plane.

15. The connector assembly of claim 13, wherein said triplet ground terminal contact portion is formed as a single contact portion.

16. The connector assembly of claim 13, wherein a width of said triplet ground terminal contact portion is greater than a corresponding width of each of said contact portions of said two signal terminals of said triplet.

17. The connector assembly of claim 13, wherein said first direction is horizontal and said second direction is vertical.

18. A connector for mating with an opposing connector, the connector comprising:

an electrically insulative connector housing;

at least a first array of three spaced-apart conductive terminals supported by said housing, the first terminal array including a pair of first differential signal terminals for transmitting differential signals therethrough and a first ground terminal associated with said first differential signal terminal pair, said first ground and differential signal terminals having contact portions at first ends thereof for contacting like terminals in the opposing connector, the contact portions of said first differential signal and ground terminals being arranged to extend in a first direction on said connector housing, said first ground and differential signal terminal contact portions being spaced apart from each other along their length such that first ground and differential signal terminal contact portions are arranged at vertices of an imaginary triangle, at least part of said first ground terminal contact portion overlying a portion of said first differential signal terminal contact portions.

19. The connector as claimed in claim 18, wherein said first differential signal and ground terminal mounting portions extend at least partially out of said connector housing.

20. The connector as claimed in claim 18, wherein said first differential signal and ground terminal mounting portions extend at least partially out of said connector housing.

21. The connector as claimed in claim 18, wherein said first differential signal and ground terminal contact portions include flat contact surfaces thereon proximate said first ends thereof.

22. The connector as claimed in claim 18, further including a second array of three spaced-apart conductive terminals supported by said housing, the second terminal array being spaced apart from said first terminal array and including a pair of second differential signal terminals and a second ground terminal associated with said second differential signal terminal pair, said second differential signal and ground terminals having contact portions at first ends thereof for contacting like terminals in the opposing connector, the contact portions of said second differential signal and ground terminals also being arranged to extend in a first direction on said connector housing, said second ground and differential signal terminal contact portions being spaced apart from each other along their length such that second ground and differential signal terminal contact portions are arranged at vertices of a second imaginary triangle, at least part of said second ground terminal contact portion overlying a portion of said second differential signal terminal contact portions.

23. The connector as claimed in claim 18, wherein said first differential signal and ground terminals further include mounting portions at second ends thereof for terminating said first differential signal and ground terminals to corresponding differential signal and ground circuit on a circuit board, and the first differential signal and ground terminal mounting portions extend in a second direction at an angle to said first direction.

24. The connector as claimed in claim 23, wherein said first differential signal and ground terminal mounting portions extend at least partially out of said connector housing.

* * * * *